United States Patent [19]

Kesling

[11] 3,983,553

[45] Sept. 28, 1976

[54] APPLIANCE REMOTE TOUCH-CONTROL PANEL WITH SOUND SYSTEM

[75] Inventor: Keith K. Kesling, Utica, Mich.

[73] Assignee: General Motors Corporation, Detroit, Mich.

[22] Filed: May 12, 1975

[21] Appl. No.: 576,802

[52] U.S. Cl. ..... 340/365 R; 340/384 E; 340/326

[51] Int. Cl.[2] ..... G08C 1/00

[58] Field of Search ..... 340/365 R, 384 E, 384 C, 340/326

[56] References Cited

UNITED STATES PATENTS

| | | | |
|---|---|---|---|
| 3,123,676 | 3/1964 | Prescott | 340/365 R |
| 3,541,548 | 11/1970 | Cogar | 340/365 R |
| 3,568,183 | 3/1971 | Shell | 340/384 E |
| 3,886,539 | 5/1975 | Gould | 346/365 C |

OTHER PUBLICATIONS

Ludeman, Wrist Worn Terminal; Apr. 1973, vol. 15, No. 11, pp. 3350, 3351.

*Primary Examiner*—Thomas B. Habecker
*Attorney, Agent, or Firm*—Edward P. Barthel

[57] ABSTRACT

A remote touch-pad control panel for a domestic appliance coordinated with a sound system for selecting domestic appliance functions whereby a different sound is audible for each function pad touched by the operator. The touch control panel has an imporforate flexible plastic skin coextensive therewith having indicia pads with the skin superimposed on a rigid outer insulating sheet having a plurality of spaced apart apertures arranged in a preselected pattern therein. The flexible skin pads have contacts on their inner surface paired with fixed contacts on an inner rigid sheet spaced by an intermediate frame from the outer sheet whereby a deflecting touch control force through the flexible plastic skin pad establishes electrical connection between the paired contacts to operate the appliance function selected and energize the sound associated therewith.

4 Claims, 5 Drawing Figures

APPLIANCE REMOTE TOUCH-CONTROL PANEL WITH SOUND SYSTEM

This invention relates to a control panel assembly for electrical appliances and is directed to a remote touch-pad control panel for a domestic appliance coordinated with a sound system whereby a different note is audible for each function pad touched.

Remote control devices for electrical appliances have been proposed for various purposes such as a convenience feature that eliminates the necessity for users of such appliances to leave their seat or other location for the purpose of switching on or off the appliance being used. An example of such a prior art system is disclosed in U.S. Pat. No. 2,835,830 to H. W. Rathenau, issued May 20, 1958. The present invention relates to a remote electrical control box assembly having a touch control panel for selecting appliance functions which are coordinated with a sound system whereby a different sound is audible for each function pad touched.

This invention therefore has for an object to provide an add-on supplemental sound system control box for a domestic appliance operative for selecting appliance functions which are coordinated with the sound system whereby a different sound is audible for each function selected by the operator to reinforce the operator's assurance of control actuation.

It is another object of the present invention to provide an improved remote touch-pad control panel for a domestic appliance having an imperforate outer skin coextensive therewith formed by a flexible plastic sheet secured to an outer electrically insulating rigid support sheet having a plurality of spaced apart apertures arranged in a preselected pattern therein, said sheet including indicia function-pads at each aperture location with each pad superimposed over one of the apertures, wherein the inner surface of each plastic sheet pad having a movable electrical contact secured thereto, and the panel including an inner rigid sheet separate from the outer sheet by an intermediate frame and the inner sheet having a plurality of adjustable fixed electrical contacts aligned with each pad contact, whereby the intermediate frame provides a space for enclosing electrical conductive means between the fixed contacts, thereby establishing a touch-pad control electrical connection between the paired movable and fixed contacts upon the application of a preselected deflecting force to the touch-pads.

These and other objects and advantages of the present invention will be apparent from the following detailed description which should be read in conjunction with the drawings in which.

Figure 3:
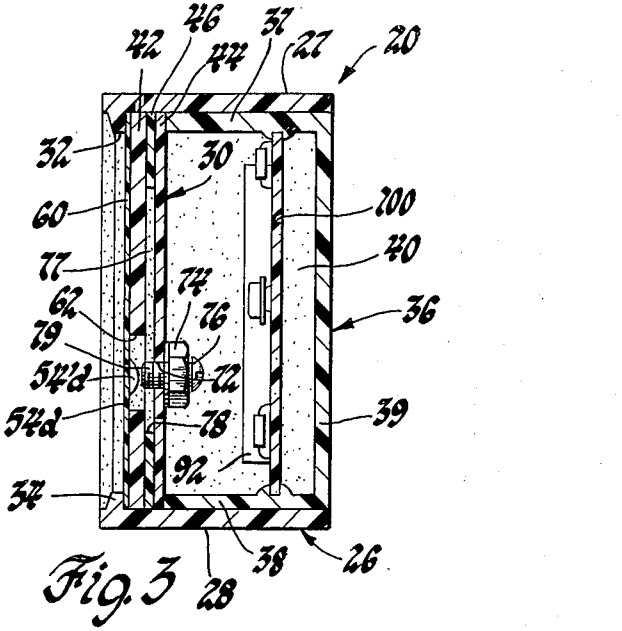
FIG. 3 is a vertical sectional view taken on the line 3—3 of FIG. 2.

In the exemplary embodiment of the invention as shown in the drawing, a conventional domestic appliance is shown which in the disclosed embodiment is a dishwasher 10 installed in a conventional kitchen base cabinet 12. An example of a typical dishwasher is U.S. Pat. No. 3,835,880 to R. E. Hoffman et al and assigned to the assignee of the instant application, the disclosure of which is incorporated by reference herein.

Figure 1:
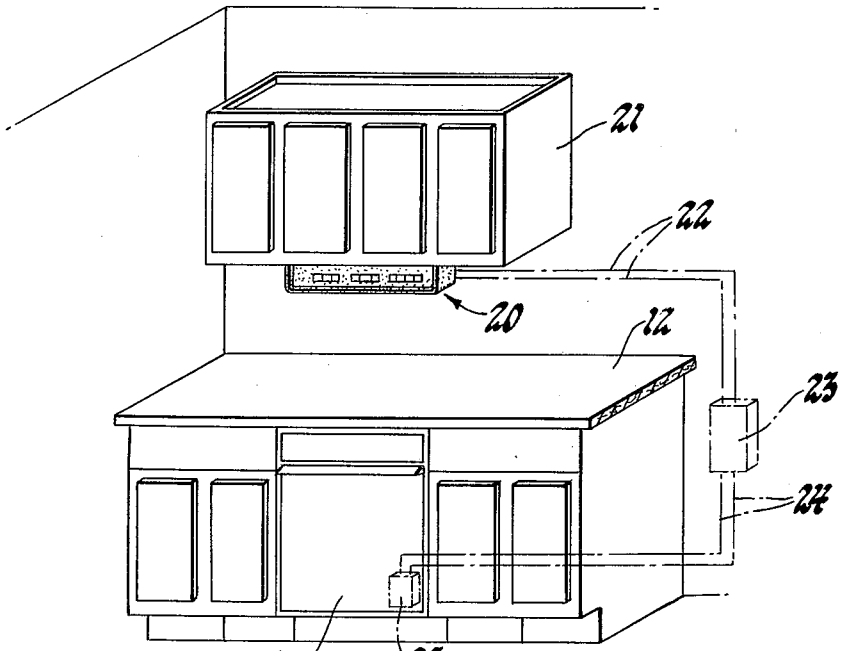
FIG. 1 is a perspective view of a dishwasher appliance installed in nested relation in a kitchen base cabinet structure and having a remote control apparatus for the appliance supported on the underside of an upper or wall cabinet assembly.

In accordance with the present invention operation of the appliance may be manually controlled by applicant's novel operating means, which in the disclosed form provides a remote control box assembly, shown generally at 20 in FIG. 1, secured to the underside of the upper kitchen cabinet enclosure 21. The assembly 20 is adapted to be connected by power lines 22 to a conventional household power supply junction box 23 and by lines 24 to the dishwasher control box 25 shown in phantom lines. The height of the dishwasher cabinet 10 may be preselected to permit fitted installation in the base cabinet 12.

Figure 2:
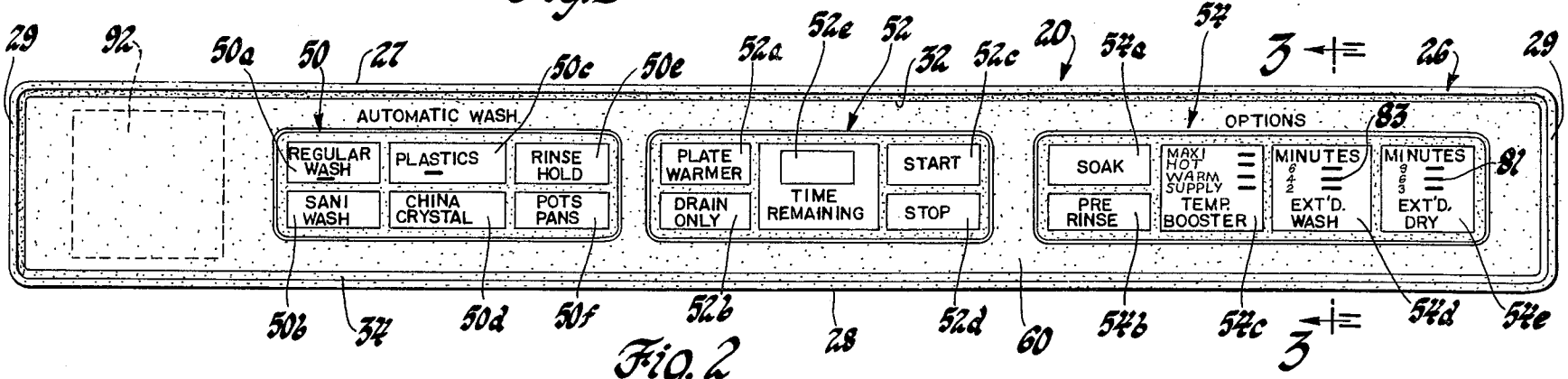
FIG. 2 is an enlarged view of the control panel of the apparatus.

Referring now to FIGS. 2 and 3, the remote touch-control assembly 20 includes an outer rectangular sleeve casing, indicated at 26, having open front and aft ends with the casing sleeve including top wall 27, bottom wall 28 and end walls 29. A composite touch-control sandwich panel structure, indicated generally by the numeral 30, is accessible through the casing open front end rectangular opening 32 which is defined by a peripheral trim portion 34. A channel member 36 has top and bottom flanges 37, 38 and a rear base wall 39 to close an electrical components chamber 40.

The composite touch-control panel member 30 includes an outer electrically insulating rigid panel 42, an inner panel 44 and an intermediate spacer frame 46 sandwiched therebetween. The panels may be formed from suitable insulating material, which in the form shown is plexiglass, with the outer panel having a thickness of about 0.125 inches and the inner panel and frame about 0.050 inches. As seen in FIG. 2, the outer panel 42 includes a plurality of spaced apart generally rectangular apertures arranged in the preselected pattern which in the disclosed form includes a grouping of six rectangular apertures indicated generally by numeral 50 located at the lefthand side of the control panel member, a center grouping of five rectangular apertures 52 and a righthand grouping of five apertures indicated generally at 54.

As viewed in FIG. 3 it will be seen that a continuous outer sheet or skin 60 of flexible impervious plastic material, which in the disclosed form is formed of Mylar film having a thickness of about 0.020 inches, is adhesively secured to the outer face of the front panel 42 by a suitable adhesive such as rubber cement. The flexible plastic sheet 60 has sufficient rigidity to prevent wrinkling and supports a plurality of electrical contact members on its inner surface. Thus, as seen for example in FIG. 3, the rectangular aperture 62 in grouping 54 has a brass roundhead button movable contact member **54'*d* adhesively secured to the inner face of the carrier sheet 60 so as to be substantially on the central axis of aperture 62.**

With reference to FIG. 2, the flexible sheet 60 has a plurality of rectangular touch control pad areas delineated thereon such as by a lighter shading or color with each touch-pad area being defined by the confines of the plurality of rectangular apertures formed in outer sheet 42. Thus the aperture 62 defines a touch-pad area **54*d*.** Each flexible sheet touch-pad area has a suitable indicia printed or adhered thereon, as by a stenciling or silk-screening operation, which indicates the function of the particular flexible pad or touch-pad area.

In the case of the disclosed dishwasher appliance the lefthand grouping of touch-pads 50 are used for the AUTOMATIC WASH cycles and the righthand grouping 54 indicate functions for the OPTIONS cycles, while the central grouping 52 provide START 52*c* and STOP 52*d* controls together with miscellaneous functions, such as Plate Warmer 52*a* and Drain Only 52*b*. The display area 52*e* could be transparent to cover a digital clock operative to give the TIME REMAINING for the various cycles. The Automatic Wash Cycle grouping 50 includes Regular Wash 50*a*, Sani Wash 50*b*, Plastics 50*c*, China Crystal 50*d*, Rinse Hold 50*e* and Pots Pans 50*f*. The righthand OPTIONS touch-pad areas include the functions of SOAK 54*a*, PRE RINSE 54*b*, TEMP BOOSTER 54*c*, EXT'D WASH 54*d* and EXT'D DRY 54*e*.

The inner panel 44 has a plurality of holes located therein such that each hole is coaxially aligned on the centers of a corresponding contact button as shown, for example, with the hole 72 aligned with the contact button 54'*d* of touch-pad 54*d*. On the rear face of the inner panel 44 are secured a plurality of threaded nuts associated with each of the holes, one of which is shown at 74 in FIG. 3 concentric with hole 72, are suitably secured as by rubber cement to the rear face of sheet 44 for the reception of a fixed contact member which in the form shown is a brass screw 76 which is threadably received within its associated nut 74 so as to extend through the intermediate wiring space 77 of the frame central rectangular cutout 78 into the rectangular aperture 62 of the front panel sheet 42. The screw 76 may be threadably adjusted axially by a screw driver to position its end face contact portion 79 in adjustable spaced relation from the movable contact button 54'*d*.

Figure 4:
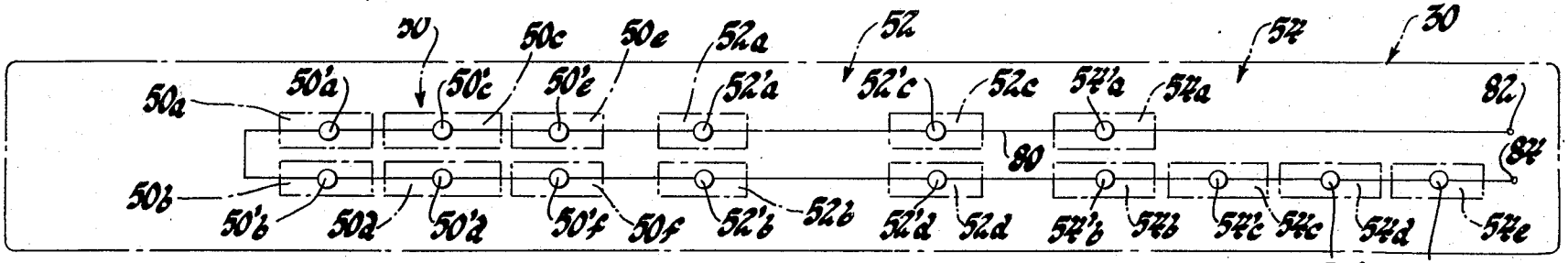
FIG. 4 is a schematic representation showing the wiring arrangement of the control panel.

With reference to FIG. 4 there is shown a plan view of the inner face of the outer sheet 42 wherein conductive means in the form of a light gauge copper wire 80 extends from the first terminal 84 horizontally to electrically connect in series each of the lower level contact buttons of the touch-pads 54*e*, 54*d*, 54*c*, 54*b* of group 54, lower contact buttons 52'*d* and 52'*b* of group 52, and lower contact buttons 50'*f*, 50'*d* and 50'*b* of group 50. The conductor then connects upper contact buttons 50'*a*, 50'*c*, 50'*e*, 52'*a*, 52'*c* and 54'*a* to terminal 82.

As seen in FIG. 3, within the components chamber 40 and mounted on a circuit board 100 is an electronic organ oscillator circuit for generating musical sounds or tones which has been disclosed in such publications as "Radio Shack Catalogue" No. 28–215, pages 7 and 23, copyrighted in 1970. By incorporating the tone generating portion of such an organ circuit in applicant's touch-pad control panel arrangement of FIG. 5 a supplemental sound system is achieved with applicant's touch control panel to reinforce the operator's awareness and assurance of the control actuation which is found in prior art mechanical switches for appliance electrical controls. Although the panel may incorporate indicator lights in area 81 for individual circuits, such as light emitting diodes (LED's), to show the time remaining for the Extended Dry cycle or in the case of area 83 for an Extended Wash cycle; the addition of sound provides an assurance of operation especially in the case of a sightless user. A touch-pad control panel renders it difficult for sightless persons to locate the correct touch-pad operating area. Even though economic considerations probably would prevent the incorporation of a sound system as a standard appliance feature applicant's invention makes such a system feasible as a customer available add-on option by virtue of his remote control panel assembly.

Applicant's device by incorporating an electric organ circuit provides a sound system that is musically correct and reasonably true in pitch to allow the sightless operator to readily determine which control is being operated. In the disclosed form of a sound system for an electronically controlled dishwasher, 15 notes are used to provide a different musical sound or tone for each operation by employing a two octave range or span musical tone generating sound system using the low note C at one end and the high note C at the other end of the scale. In this way the pad grouping 50 top segment pads 50*a*, 50*c* and 50*e* uses the upper "C" major scale notes C, E and G respectively, while the lower segment pads 50*b*, 50*d* and 50*f* control the "D" minor scale notes D, F and A, respectively. The touch pad grouping 52 top segment pads control the middle "C" major scale with pads 52*a* and 52*c* controlling note E and note middle C while the lower segment pads 52*b* and 52*d* control note G and note high C to provide an octave difference between START pad 52*c* controlling the note middle C and STOP pad 52*d* controlling the note high C. The righthand OPTIONS use notes B and B from both octaves for pads 54*a* and 54*b* to provide a single octave spread therebetween, while pads 54*c*, 54*d* and 54*e* use the "D" minor scale notes D, F and A, respectively. Thus, each pad grouping has a different musical sound level allowing the operator to readily locate the desired grouping 50, 52 or 54 by merely moving his fingers over the control panel surface to audibly locate the grouping prior to starting the appliance which requires programmed sequence of touch control settings as disclosed in the Gould Pat. No. 3,819,906, for example.

Figure 5:
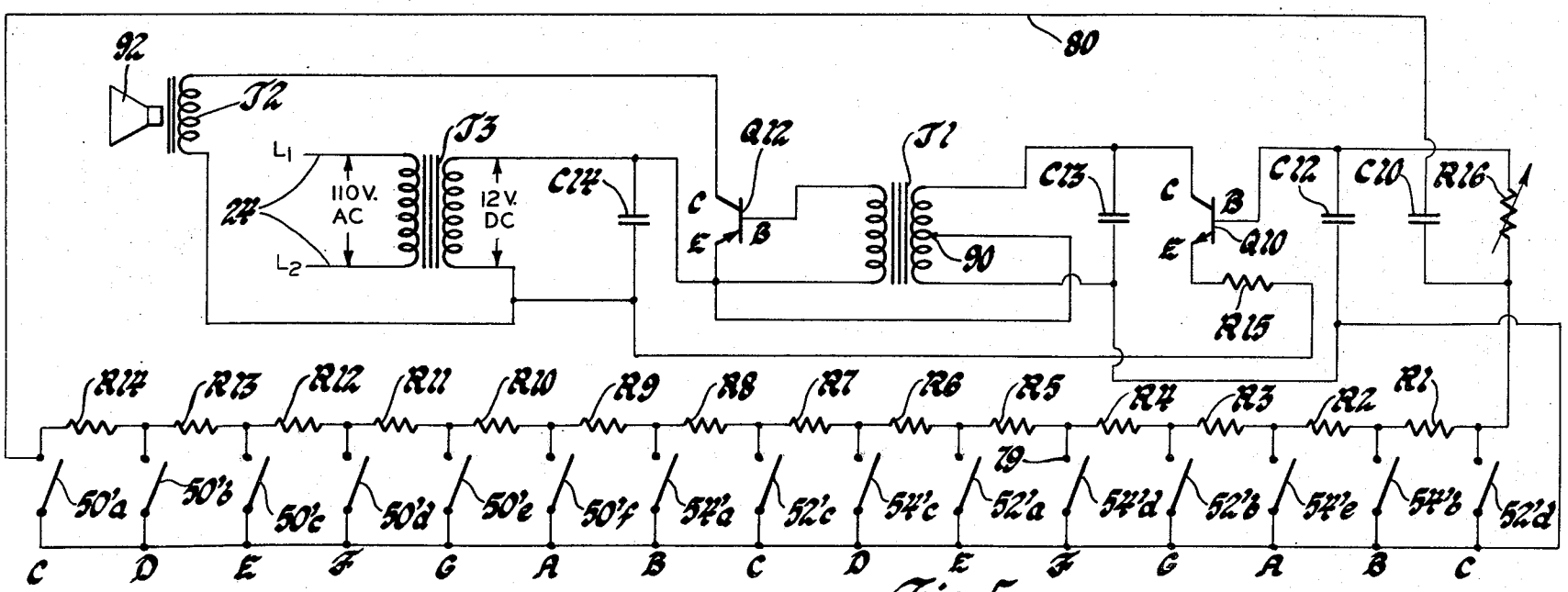
FIG. 5 is a schematic of the electrical sound producing portion of the invention.

Referring now to FIG. 5, there is shown a schematic illustration of the known electronic organ circuit wherein the plurality of touch-pad or flexible pad control switches 50*a*–50*f*, 52*a*–52*d* and 54*a*–54*e* are indicated by primes at 50'*a*–50'*f*, 52'*a*–52'*d* and 54'*a*–54'*e*, respectively. The switches control resistances $R_1$—$R_{14}$ which are series connected through a variable tone adjusting resistor R16 to the base of a transistor Q10 which forms, with a second transistor Q12, a simple audio amplifier circuit providing enough power to make the tones of the control panel clearly audible. The amplifier circuit itself will not create a tone so that a small sample of the signal is taken from a transformer T1 and passed through a resistor-capacitor network comprised of resistances R1 through R14 and a capacitor C10 and is fed back into the base of transistor Q10 to provide a positive feedback circuit dependent upon which resistor R1 through R14 is switched into the circuit by depressing one of the touch-pads of the remote control panel 30 thereby reproducing a distinctive audible frequency. The base of transistor Q10 is also connected through a capacitor C12 and capacitor C13 to the primary windings of the transformer T1 having a center tap 90 connected by a circuit to the emitter E of the transistor Q12. The collector C of the transistor Q12 is connected to the input of a speaker transformer T2 which in turn drives a loud speaker 92.

The circuit is energized by a voltage step-down transformer T3 which has its primary supplied from the house wiring input terminals $L_1$ and $L_2$ connected to 120 volt power source of AC supply voltage junction box 23 via lines 24. The transformer T3 secondary provides a 12 volt D.C. output for the circuit through buffer capacitor C14, which is connected through emitter voltage dropping resistor R15 to the emitter of transistor Q10.

It will be noted in FIG. 5 that while only contact portion 79 of screw 76 is indicated as the fixed contact of movable switch 54'*d*, an identical fixed contact arrangement is provided for all the flexible sheet contacts of the control panel. Also it will be seen in FIG. 5 that the two octave span notes are labeled to correspond with their associated touch-pad switches.

While the embodiment of the present invention as herein disclosed constitutes a preferred form, it is to be understood that other forms might be adopted.

I claim:

1. A touch control apparatus for a domestic appliance comprising, an elongated box-shaped casing having a rectangular opening in one side wall, a composite touch responsive control panel assembly closing said wall opening, the user's side of said panel assembly presenting a continuous uninterrupted surface formed by a flexible sheet of impervious plastic material having deflectable areas, said user's side having a plurality of appliance control flexible pads delineated thereon at said deflectable areas with each pad including indicia defining an appliance function, electrically conducting means on said panel assembly in the form of a plurality of single fixed contacts, each of said fixed contacts arranged to interconnect with a movable contact member secured on the inner face of each said flexible pad at a deflectable area providing a series of flexible pad switches, a musical tone generator circuit including a speaker positioned in said casing, each said flexible pad switch being responsive to a preselected deflecting force to the flexible pad to selectively establish an electrical path for the flow of current between different portions of said circuit, and each said flexible pad switch being operative when closed to select a predetermined resistive value in said tone generator circuit causing an electrical pulse to generate a frequency for driving said speaker producing a predetermined audible tone, whereby a distinguishable audible musical tone is obtained for each flexible pad switch to assure the user of the actuation of the preselected appliance function.

2. A touch control apparatus for a domestic appliance comprising, an elongated casing having an opening in one side wall, a composite touch responsive control panel assembly closing said wall opening, said composite assembly including outer and inner electrically insulating panels, said outer panel having a plurality of spaced apart apertures arranged in a preselected pattern, said inner panel having a plurality of fixed electrical contacts thereon extending forwardly therefrom in axial alignment with each of said apertures, an intermediate frame sandwiched between said outer and inner panels, said frame being formed with a central cutout similar in shape to said panels but of a size smaller than that of said panels, said composite panel assembly including a flexible sheet of impervious plastic material on the outer surface of said outer panel having deflectable areas, said sheet presenting a continuous uninterrupted body superimposed over said outer panel, said sheet having a plurality of appliance control flexible pads on the user's side at said deflectable areas, each said deflectable area defined by one of said outer panel apertures, said sheet having each of its flexible pads provided with a movable electrical contact on its inner surface protruding into its associated outer panel aperture, electrically conductive means in said frame cutout arranged to interconnect said sheet movable contacts, said fixed and movable contacts providing a series of flexible pad switches, each said flexible pad switch being operative for selective deflection of its movable contact into engagement with its associated fixed contact in response to a preselected force to its associated sheet deflectable area.

3. A remote touch control apparatus for a domestic appliance comprising, an elongated box-shaped casing having a rectangular opening in one side wall, a composite control panel assembly closing said wall opening, said composite assembly including outer and inner electrically insulating panels, said outer panel having a plurality of spaced apart apertures arranged in a preselected pattern, said inner panel having a plurality of fixed electrical contacts thereon extending forwardly therefrom in axial alignment with each of said apertures, an intermediate frame sandwiched between said outer and inner panels, said frame being formed with a central rectangular cutout similar in shape to said panels but of a size smaller than that of said panels, said composite panel assembly including a flexible sheet of impervious plastic material having deflectable areas on the outer surfaces of said outer panel, said sheet presenting a continuous uninterrupted body superimposed over said outer panel, said sheet having a plurality of appliance control flexible pads on the user's side at said deflectable areas with each pad including indicia defining an appliance function, each said deflectable area defined by one of said outer panel apertures; said sheet having each of its flexible pads provided with a movable electrical contact on its inner surface protruding into its associated outer panel aperture, electrically conductive means in said frame cutout arranged to interconnect said flexible sheet movable contacts, a musical tone generator circuit including a speaker positioned in said casing, said fixed and movable contacts providing a series of flexible pad switches, each said flexible pad switch being operative for selective deflection of its movable contact into engagement with its associated single fixed contact in response to a preselected deflecting force to its associated sheet flexible pad, each said flexible pad switch being operative when closed to select a predetermined resistive value in said tone generator circuit causing an electrical pulse to generate a frequency for driving said speaker producing a predetermined audible tone, whereby a distinguishable audible musical tone is obtained for each flexible pad switch to assure the user of the actuation of the preselected appliance function.

4. The apparatus of claim 3 wherein the fixed contacts are axially adjustable to allow for adjustment of the deflecting force required to close the switches.

* * * * *